US009456683B2

(12) United States Patent
Price et al.

(10) Patent No.: US 9,456,683 B2
(45) Date of Patent: Oct. 4, 2016

(54) ARTICLE OF FURNITURE

(71) Applicants: Donald Kevin Price, Glendale, CA (US); Jeffrey Justice McSwain, Glendale, CA (US)

(72) Inventors: Donald Kevin Price, Glendale, CA (US); Jeffrey Justice McSwain, Glendale, CA (US)

( * ) Notice: Subject to any disclaimer, the term of this patent is extended or adjusted under 35 U.S.C. 154(b) by 0 days.

(21) Appl. No.: 14/578,866

(22) Filed: Dec. 22, 2014

(65) Prior Publication Data

US 2015/0173504 A1 Jun. 25, 2015

Related U.S. Application Data

(60) Provisional application No. 61/919,900, filed on Dec. 23, 2013.

(51) Int. Cl.

| | |
|---|---|
| ***A47B 3/00*** | (2006.01) |
| ***A47B 3/06*** | (2006.01) |
| ***A47B 13/00*** | (2006.01) |
| ***A47B 13/02*** | (2006.01) |

(52) U.S. Cl.

CPC ..... *A47B 3/06* (2013.01); *A47B 13/003* (2013.01); *A47B 13/021* (2013.01); *A47B 2230/0092* (2013.01)

(58) Field of Classification Search

CPC ..... A47B 3/06; A47B 13/003; A47B 13/088
USPC ..... 108/153.1, 154, 155, 156, 157.1, 108/157.15, 157.16, 159, 158.12; 248/165, 248/440; 403/381, 187, 189, 198, 192, 194, 403/199

See application file for complete search history.

(56) References Cited

U.S. PATENT DOCUMENTS

| | | | | | |
|---|---|---|---|---|---|
| 114,515 | A | * | 5/1871 | Beek | A47B 3/12 108/154 |
| 752,243 | A | * | 2/1904 | Mock | A47C 5/02 248/440 |
| 1,481,560 | A | * | 1/1924 | Ringer | A47B 43/02 312/258 |
| 1,696,193 | A | * | 12/1928 | Deland | A47B 3/12 108/157.15 |

(Continued)

FOREIGN PATENT DOCUMENTS

| | | | |
|---|---|---|---|
| DE | 2638278 | * | 6/1977 |
| DE | 29517415 | * | 2/1996 |

(Continued)

OTHER PUBLICATIONS www.ebay.com/itm/200923235132?hlp=false&var=; Amish Chairs Arm Side Dining Turnbuckle Desk Home Office Furniture Solid Wood as shown on Sep. 24, 2013.

(Continued)

*Primary Examiner* — Janet M Wilkens
(74) *Attorney, Agent, or Firm* — Maier & Maier, PLLC

(57) ABSTRACT

According to at least one exemplary embodiment, an article of furniture may be stabilized by one or more stretchers capable of contracting or extending to create a stabilizing force between the components of the furniture. The article of furniture may include a top surface member and a plurality of support members. The one or more stretchers may engage the support members, applying a stabilizing force. The furniture may be assembled and disassembled quickly and without the use of irreversible couplings such as nails, screws, staples, or adhesives.

20 Claims, 6 Drawing Sheets

(56) References Cited

U.S. PATENT DOCUMENTS

| | | | | | |
|---|---|---|---|---|---|
| 2,147,437 | A * | 2/1939 | Gross | A47C 7/002 | 248/440 |
| 2,582,243 | A * | 1/1952 | Eide | A47F 5/10 | 108/101 |
| 2,789,631 | A * | 4/1957 | Vosbikian | A47C 5/04 | 108/154 |
| 2,982,344 | A * | 5/1961 | Berlin | A47C 7/62 | 248/279.1 |
| 3,312,503 | A | 4/1967 | Suzuki | | |
| 3,432,132 | A * | 3/1969 | Thurston | A47B 3/04 | 108/154 |
| 3,632,179 | A | 1/1972 | Vredevoogd | | |
| 4,199,124 | A * | 4/1980 | Tachida | A47B 13/021 | 248/188 |
| 4,351,621 | A * | 9/1982 | Liou | A47B 13/02 | 248/165 |
| 4,504,168 | A * | 3/1985 | Miller | A47B 13/021 | 131/270 |
| 4,676,174 | A * | 6/1987 | Dingeldey | B25H 1/04 | 100/111 |
| 5,975,470 | A * | 11/1999 | Casey | A61M 5/1782 | 248/121 |
| 6,200,062 | B1 * | 3/2001 | You | F16B 12/20 | 403/230 |
| D441,204 | S | 5/2001 | Bernich | | |
| 2010/0290831 | A1 | 11/2010 | Burnett et al. | | |

FOREIGN PATENT DOCUMENTS

| | | | |
|---|---|---|---|
| DE | 10020487 | * | 10/2001 |
| EP | 979626 | * | 2/2000 |

OTHER PUBLICATIONS www.google.com/shopping/product/13504949702424528; CG Sparks Turnbuckle 3 Piece Dining Set as shown on Sep. 24, 2013.

www.overstock.com/Worldstock-Fair-Trade/Iron-Turbuckle; Iron Turnbuckle Coffee Table as shown on Sep. 24, 2013.

www.google.com/search?q=turnbuckle+furniture&tbm=iscl; Misty Mountain Furniture—Reclaimed Wood Tur . . . as shown on Sep. 24, 2013.

www.google.com/search?q=turnbuckle+furniture&tbm=iscl; Sunny Designs Vineyard Distressed Mahogany . . . as shown on Sep. 24, 2013.

www.google.com/search?q=furniture+shaped=legs&tbm . . . ; Stanley Furniture European Farmhouse Farmer' . . . as shown on Sep. 24, 2013.

www.google.com/search?q=furniture+with+sheet+of+inter . . . ; Andrew Muggleton—Furniture Design—Side Tab . . . as shown on Sep. 24, 2013.

www.google.com/search?q=furniture+with+sheet+of+inter . . . ; End Tables With Cross Leg Base/Wayfair as shown on Sep. 24, 2013.

www.google.com/search?q=criss-cross+side+table&hl=en& . . . ; Criss Cross Table—WENGE—contemporar . . . as shown on Sep. 25, 2013.

www.google.com/search?q=criss-cross+side+table&hl=en&; Polished Steel Table / AllModern as shown on Sep. 25, 2013.

www.google.com/search?q=criss-cross+side+table&hl=en&; End Table With Criss Leg Base / AllModern as shown on Sep. 25, 2013.

* cited by examiner

ARTICLE OF FURNITURE

PRIORITY CLAIM

This application claims priority to U.S. Provisional Application No. 61/919,900, filed Dec. 23, 2013, the contents of which are herein incorporated by reference.

BACKGROUND

Furniture is formed in a variety of manners and using a variety of components. However, furniture is typically assembled in a fixed manner, rendering it difficult or impossible to assemble or disassemble. This can make furniture components, such as the frame, very difficult to replace if they become worn or damaged, because replacing these components can require that the furniture in question be partially or completely disassembled in order for the component to be accessed. This may generally cause furniture repairs to be more onerous and expensive, and, if sufficiently so, may lead to excess waste and poorer outcomes for consumers; for example, consumers may find it necessary to throw out a generally serviceable piece of furniture that they would prefer to keep merely because one difficult-to-replace component is broken.

The use of irreversible couplings, such as nails, screw, staples, or adhesives, may also restrict the ability of users to move their furniture around within the home or transport it from place to place. Items of furniture, such as tables, benches, and sofas, are often very heavy, bulky, and generally difficult to transport without the assistance of a number of persons or a skilled moving team. Further, select components of many common furniture designs may be more sensitive to damage. For example, the glass in a glass-topped coffee table may be readily etched or broken, and may require more protection or a different manner of protection than the remainder of the coffee table may need; alternatively, the legs of that same coffee table may be bent or even broken if struck on the side with sufficient force, which may be a greater risk if the table must be transported with legs fully extended.

Further, the use of irreversible couplings can further prohibit the manipulation of furniture. Irreversible couplings may be difficult or impossible to adjust once set in place, depending on the nature of the irreversible coupling (for example, a screw versus an adhesive). This may limit the extent to which users may customize their own furniture to their needs, body types, etc., which may detract from the user experience. An inability for end users to readily customize furniture may also require retailers and distributors to allocate more warehousing and/or showroom space to pre-customized models and may ensure that end users have difficulty finding furniture suited to their needs, in both cases increasing inefficiency.

SUMMARY

According to at least one exemplary embodiment, an article of furniture may be provided. The article of furniture may include a surface member and a plurality of supports having at least one engagement area. The article may further include one or more stretcher of adjustable length. The stretcher may removably engage at least two of the supports. The one or more stretcher may have at least two stretcher ends for engaging the at least one engagement area of the supports. The article may further have tension adjusters that control the lengths of the one or more stretchers such that the one or more stretchers may apply or resist force on the at least two engaged supports.

According to at least one other exemplary embodiment, an article of furniture may be provided. The article of furniture may include a surface member and a plurality of supports having at least one engagement area. The article of furniture may further include one or more support receptacle receiving cavities and one or more support receptacles. The support receptacles may have a substantially downward-facing slot that is sized to accommodate at least one of a plurality of supports and the one or more support receptacle may have a securing portion for engaging the one or more support receptacle receiving cavity. The article may further include one or more stretcher of adjustable length. The stretcher may removably engage at least two of the supports. The one or more stretcher may have at least two stretcher ends for engaging the at least one engagement area of the supports. The article may further have tension adjusters that control the lengths of the one or more stretchers such that the one or more stretchers may apply or resist force on the at least two engaged supports.

BRIEF DESCRIPTION OF THE FIGURES

Advantages of embodiments of the present invention will be apparent from the following detailed description of the exemplary embodiments thereof, which description should be considered in conjunction with the accompanying drawings in which like numerals indicate like elements, in which.

Exemplary

Exemplary

Exemplary

Exemplary

Exemplary

Exemplary

Exemplary

Exemplary

Exemplary

Exemplary

Exemplary

Exemplary

DETAILED DESCRIPTION OF THE EMBODIMENTS

Figure 1:
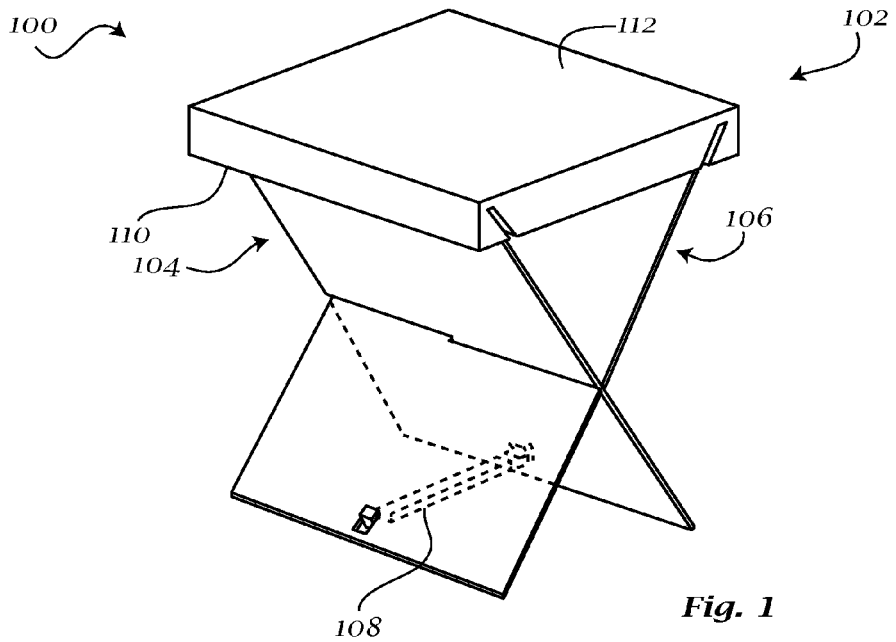
FIG. 1 shows a perspective view of an article of furniture.
Figure 2:
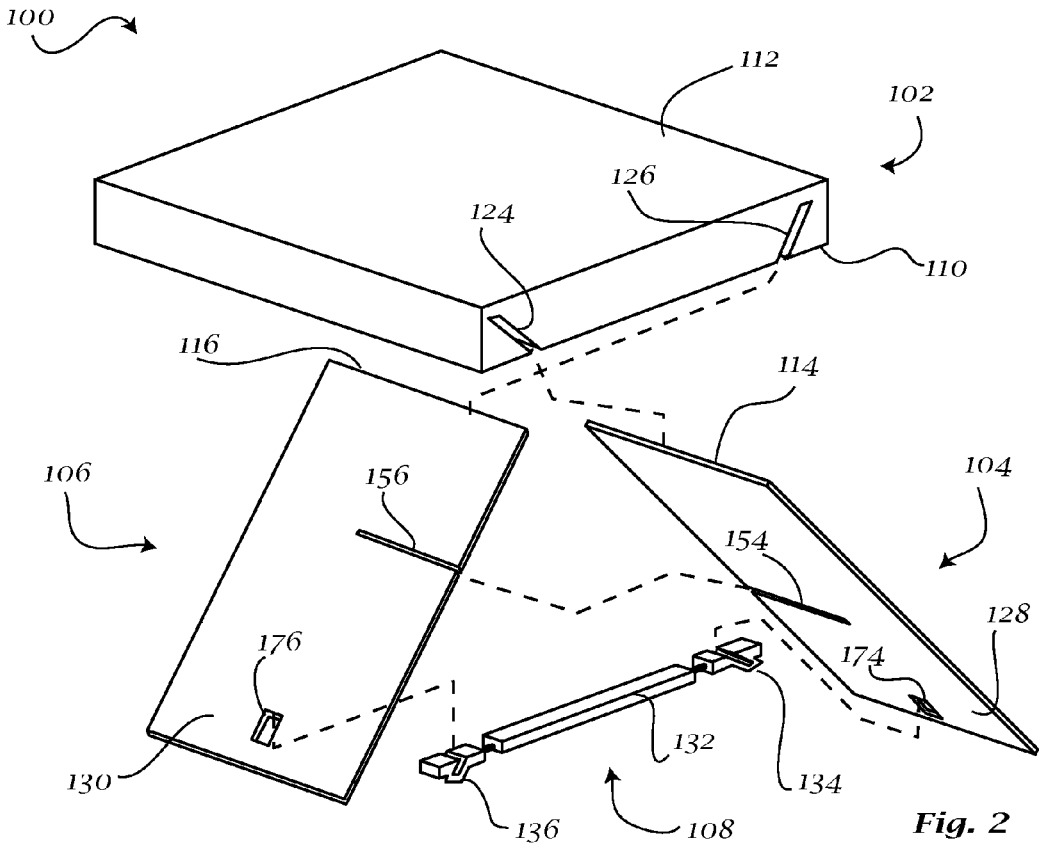
FIG. 2 shows an exploded perspective view of an article of furniture.
Figure 3:
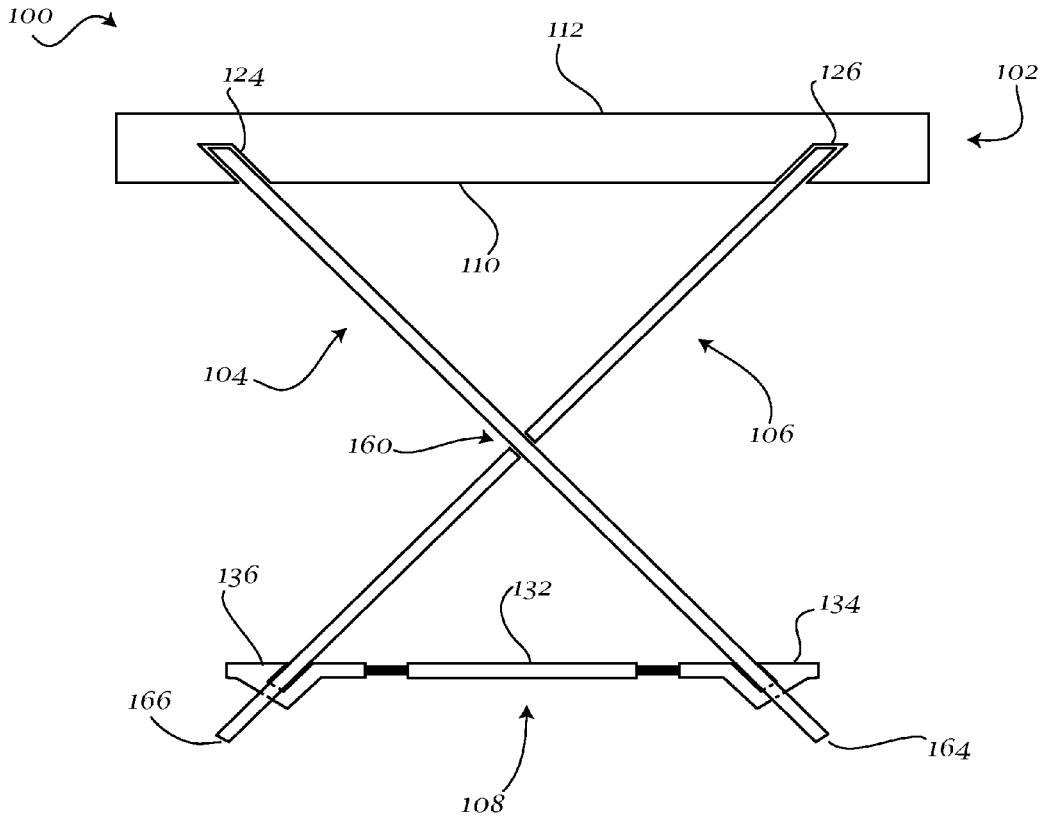
FIG. 3 shows an elevation view of an article of furniture.
Figure 4:
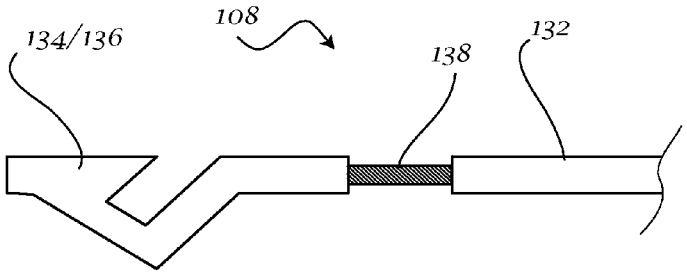
FIG. 4 shows an elevation view of a stretcher.
Figure 5:
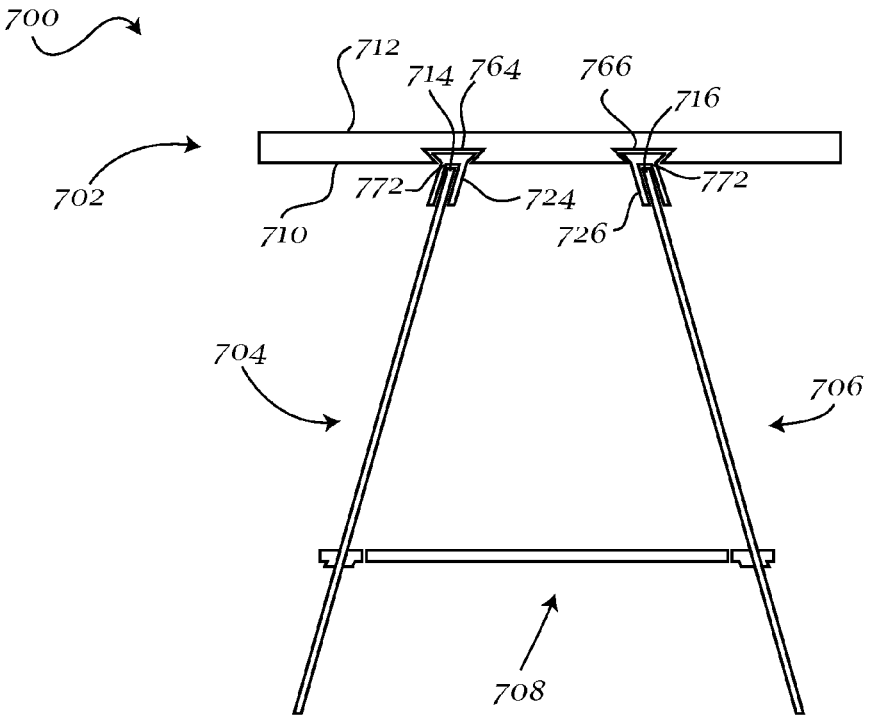
FIG. 5 shows an elevation view of a second embodiment of an article of furniture.
Figure 6:
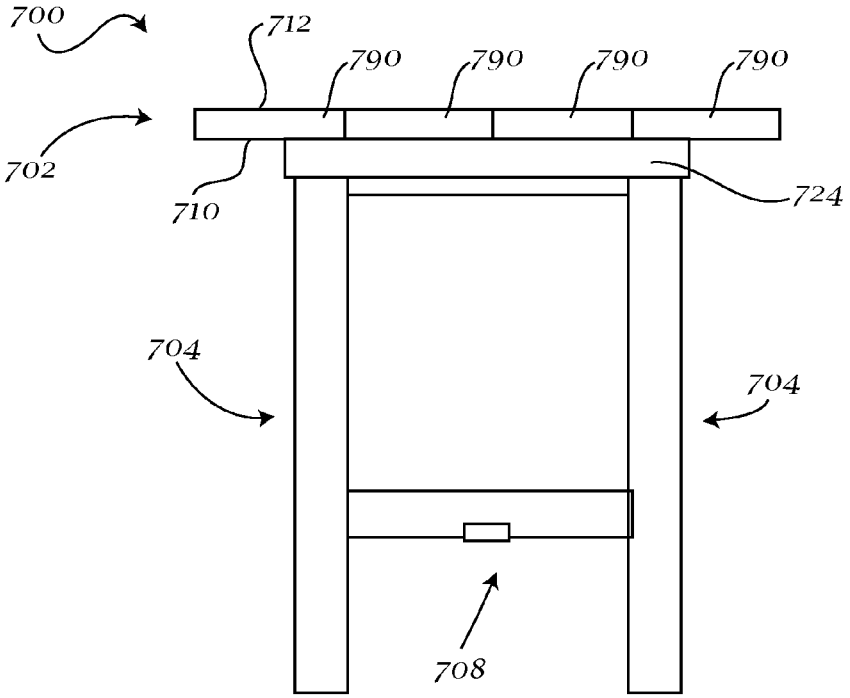
FIG. 6 shows an elevation view of a second embodiment of an article of furniture.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

The word "exemplary" is used herein to mean "serving as an example, instance, or illustration." Any embodiment described herein as "exemplary" is not necessarily to be construed as preferred or advantageous over other embodiments. Likewise, the term "embodiments of the invention" does not require that all embodiments of the invention include the discussed feature, advantage or mode of operation.

According to some exemplary embodiments, and generally referring to exemplary FIGS. 1-6, furniture 100 can have a surface member 102, one or more supports, for example a first support 104 and a second support 106, and one or more stretchers, for example a first stretcher 108. The surface member 102 may have a surface member bottom 110 and a surface member top 112. Surface member 102 may be formed in any shape such that the furniture 100 can serve as a common piece of furniture such as a table, stool, chair, bench, couch, or the like. The supports 104 and 106 can be legs, panels, or any other known support member.

In some exemplary embodiments, surface member bottom 110 may have a plurality of slots 124, 126 that may be used to accommodate supports; for example, the surface member bottom 110 may have two such slots 124 and 126, each of which may act as a receptacle for the top edge of a support 114, 116. The first support top edge 114 of the first support 104 may be inserted into the surface member bottom first slot 124 and the second support top edge 116 of the second support 106 may be inserted into the surface member bottom second slot 126. First surface member bottom slot 124 and second surface member bottom slot 126 may be angled within the surface member 102. Alternatively, any similarly functioning device, as would reasonably be understood by a person having ordinary skill in the art, may be used to replace slots 124 and 126 in a surface member bottom 110. For example, the support receptacles 724/726 described in reference to FIG. 7 may be used. Slots 124, 126 or receptacles 724/726 may be disposed at an angle in relation to surface member 102.

Some exemplary embodiments of furniture 100 may be assembled by first inserting the first support top edge 114 into the first surface member bottom slot 124 and the second support top edge 116 into the second surface member bottom slot 126. A stretcher 108 may then be inserted between the first support 104 and the second support 106; stretcher 108 may consist of at least one rigid or semi-rigid beam or other support structure and may resist tension or compression provided by the first and second support 104, 106. A stretcher 108 may engage a support at an engagement area, which may include support slots 174, 176 or other suitable location on a support. Loading on the support may be uniaxial, or, alternatively, the stretcher 108 may support biaxial or triaxial loading. In the case that the stretcher 108 is only anticipated to be under tension, a flexible support structure such as a chain or cord may also be used. Stretcher 108 may be put into place by coupling a first stretcher end 134 of the stretcher 108 to a bottom end portion 128 of the first support and a second stretcher end 136 of the stretcher 108 to a bottom end portion 130 of the second support. The stretcher 108 may then be contracted or extended, for example by hand turning a tension adjuster 132 which may be a center portion of the stretcher 108. Stretcher 108 may be otherwise configured. For example, tension adjuster 132 may alternatively be separate from a center portion of stretcher 108. Tension adjuster 132 may further be disposed elsewhere on stretcher 108. In other exemplary embodiments, multiple tension adjusters 132 may be implemented on a single stretcher 108. Tension adjuster 132 may cause the first stretcher end 134 and the second stretcher end 136 to contract or separate, consequently pulling or pushing the first support bottom end portion 128 and the second support bottom end portion 130 towards or away from each other. Tension adjuster 132 may be a ratchet or a turnbuckle, may be pin-adjustable, or may be another device capable of expanding or contracting to a desired length. The contraction or extension of the stretcher 108 can allow the components of the furniture 100 to engage to cause tension between the components such that the furniture 100 is stabilized. This can allow for furniture 100 to be assembled and disassembled quickly and without the use of irreversible couplings such as nails, screw, staples, or adhesives. Instead, assembly of the furniture 100 may only require that the stretcher 108 be put into place between the supports 104, 106, appropriately extended to a length slightly longer than the distance between the bottom end portions of the supports 128, 130, and then contracted to engage the supports 104, 106. Disassembly may only require that the stretcher 108 be expanded to disengage the supports 104, 106, at which point both the stretcher 108 and the supports 104, 106 may be removed. Alternative embodiments, such as those featuring a tension cable or other tensioning device as a stretcher 108, may be assembled and disassembled with similar ease.

In some exemplary embodiments, the first support 104 may be a panel with a first support slot 174. Similarly, the second support 106 may be a panel with a second support slot 176. The first stretcher end 134 and the second stretcher end 136 may both be devised as to be able to engage securely with first support slot 174 and second support slot 176, respectively. In other embodiments, such as embodiment 700 shown in FIGS. 5-7, the support slots 174, 176 may alternatively be simply engagement areas on a support. The stretcher 108 may be a mechanical device with two ends 134 & 136 that draw together or apart when the tension adjuster 132 is rotated such that while first stretcher end 134 is engaged with first support slot 174 and second stretcher end 136 is engaged with second support slot 176, the tension adjuster 132 may be turned to cause the contraction or extension described above. In at least one embodiment, this may be accomplished through a threaded connection between tension adjuster 132 and stretcher ends 134, 136. Tension adjuster 132 may be rotated by hand in an exemplary embodiment. The threaded connections may be reversed for each end, such that as the tension adjuster 132 is rotated in a single direction, both ends may be caused to draw together or apart by the same rotation of the adjuster 132. There may be at least one connecting member 138. In an exemplary embodiment, there may be a connecting member 138 affixed to stretcher ends 134, 136 and connecting member 138 may retractably engage adjuster 132. In embodiments having separate connecting members 138 for each stretcher end 134, 136, connecting members 138 may be fixedly connected to one of the adjuster 132 or the stretcher ends 134, 136, or the connecting member 138 may be threadably connected to both the adjuster 132 and the stretcher ends 134, 136. In alternative embodiments there may be a single connecting member 138, the connecting member 138 may be fixed to the adjuster 132 and the stretcher ends 134, 136 may move along the connecting member 138 as it rotates with adjuster 132.

Other embodiments may have multiple support slots disposed in supports 104, 106, allowing for multiple stretchers 108 or for a stretcher having multiple stretch ends. Additional support slots may be located at different heights on the supports 104, 106, for example near the top of the supports 104, 106 to better ensure that the topmost edges of the supports 114, 116 stay engaged with the surface member bottom slots 124, 126. This may additionally prevent an overloading of force on surface member bottom slots 124, 126. Alternatively, additional support slots may be placed at the same height, and may be used to better distribute tensile and/or compressive loading from the stretchers 108 evenly over the full width of the supports 104, 106.

Additionally, in some embodiments, first support 104 may have a first support middle slit 154 and second support 106 may have a second support middle slit 156. First support 104 and second support 106 may be engaged with each other via their respective middle slits 154 and 156 to form a pivot point 160 between the first support 104 and second support 106 which can provide further stability to the furniture when it is tensioned. The furniture may stand on the first support bottom edge 164 and the second support bottom edge 166. If more than two supports 104, 106 are used, all may engage at this pivot point 160, or pluralities of supports 104, 106 may engage at separate pivot points 160. In some alternative embodiments, such as furniture 700 shown in exemplary FIG. 5, the supports may not engage at a pivot point.

In yet other embodiments, furniture 100 may have multiple surface members 102. The multiple surface members 102 may include corresponding bottom slots 124, 126. This may allow a single support 114, 116 to engage at least one surface member 102. When engaged with multiple surface members 102, the tension on the supports 114, 116 may apply a force to the surface members 102, securing them in place. The weight of the surface member 102 may contribute to the force. The stretcher 108 may also contribute to the force.

Referring now to exemplary embodiments shown in FIGS. 5-7*b*, furniture 700 may have a surface member 702, one or more supports, for example a first support 704 and a second support 706, one or more support receptacles, for example a first support receptacle 724 and a second support receptacle 726, and one or more stretchers, for example a first stretcher 708. The surface member 702, which may have a surface member bottom 710 and a surface member top 712, may be formed in any shape such that the furniture 700 can serve as any common piece of furniture such as a table, stool, chair, bench, couch, or the like. The surface member 702 may have one or more support receptacle receiving cavities, for example a first receptacle receiving cavity 764 and a second receptacle receiving cavity 766.

Figure 7A:
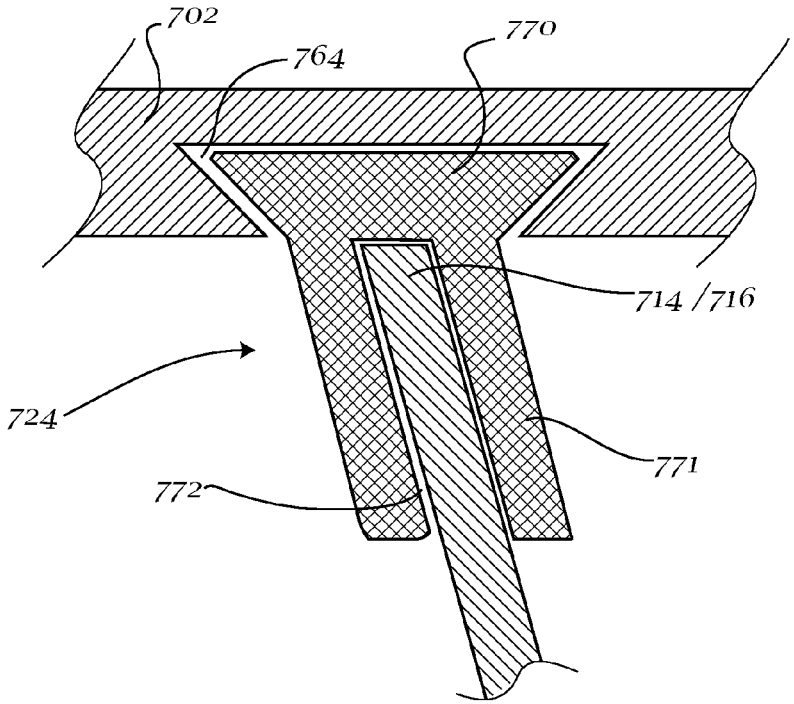
FIG. 7*a* shows cross-sectional view of a support receptacle.
Figure 7B:
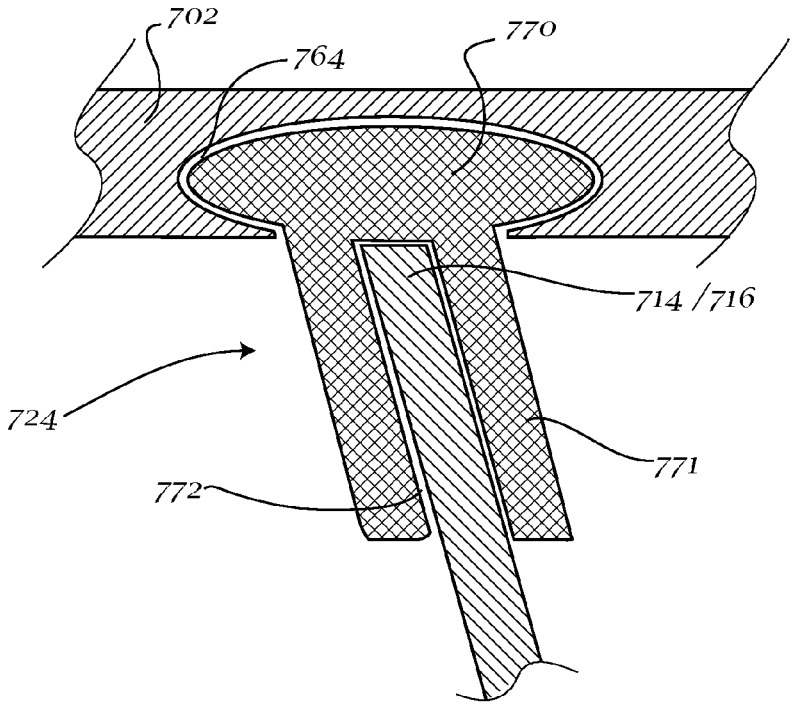
FIG. 7*b* shows a cross-sectional view of a support receptacle.

A support receptacle 724, 726 may have a securing portion 770 to secure in a receptacle receiving cavity 764, 766 in a furniture surface member 702 and a support receiving slot 772 to accept a support top edge, for example a first support top edge 714 or a second support top edge 716. Support receiving slot 772 may be formed by receiving slot walls 771. This may allow for a surface member portion 702 to have a shallower profile than if the support receiving slots are integrated into the surface member 702. In at least one exemplary embodiment, securing portion 770 of support receptacles 724, 726 may be of a dovetail variety as shown in FIG. 7*a*, an oval variety as shown in FIG. 7*b*, or a rectangular or other joint variety, as would be understood by a person having ordinary skill in the art, and may slide in a support receptacle receiving cavity 764, 766. Furniture surface member 702 may include multiple pieces, such as multiple planks or boards 790. A support receptacle receiving cavity 764, 766 may be disposed in the bottom of several pieces 790 of a furniture surface member 702, which may align to create integrated support receptacle receiving cavities 764, 766. In some embodiments, securing portion 770 may extend along a longitudinal axis further than a support receiving slot 772. This may allow the securing portion 770 to interact with a desired number of surface member pieces 790, while allowing the support receiving slot 772 to be sized appropriately for a support 704 or 706. A support receptacle 724, 726 may be sized to slide or otherwise secure in such a support receptacle receiving cavity. Alternatively, a support receptacle 724, 726 may be formed integrally within surface member 702 or permanently affixed thereto. In embodiments where surface member portion 702 may include multiple surface member pieces 790, support receptacle 724, 726 may secure surface member pieces 790 together to create a furniture surface member 702. When supports 704, 706 are inserted in support receptacles 724, 726 and force is applied to supports 704, 706 by the weight of the surface member or by a first stretcher 708, the tension may further secure the assembly. Stretcher 708 may function substantially as described regarding FIGS. 1-6. A support receiving slot may be angled, allowing supports 704, 706 to be disposed at an angle; according to some embodiments, this angle may be variable. Alternatively, numerous support receptacles 724, 726 having different shapes or angles may be made available, which may fit the same support receptacle receiving cavities 764, 766 and which may be freely interchanged with each other. The supports 704 and 706 may be legs, panels, or any other known support member.

Now referring to exemplary FIGS. 8-11, other exemplary embodiments may be disclosed. Exemplary FIGS. 8 and 9 may show an alternative embodiment of a support receptacle 824. Support receptacle 824 may include a securing portion 870 and may have a receiving slot 872 formed by receiving slot walls 871. Securing portion 870 may fit, substantially peg-like, in a cavity 803 disposed in a surface 802. The cavity may extend partially or completely through surface 802. Securing portion 870 may be substantially cuboidal, cylindrical, or a variety of other shapes, as would be understood by a person having ordinary skill in the art. Securing portion 870 and cavity 803 may be formed perpendicular to surface 802 or at an angle. Similarly, receiving slot 872 may be disposed perpendicular to surface 802 or at an angle, so as to match a desired angle of supports 804. Receiving slot 872 may receive a top edge 814 of a support 804. Receiving slot walls 871 may be formed to match the cross-sectional shape of a support 804, such that receiving slot walls 871 fully surround a top edge 814 of support 804. Support 804 may be any number of shapes or sizes, including having a circular, triangular, rectangular, square, pentagonal, hexagonal, octagonal, oval, or other uniquely designed cross-sectional shape or size. Alternatively, receiving slot walls 871 may only surround a portion of a top edge 814.

Figure 8:
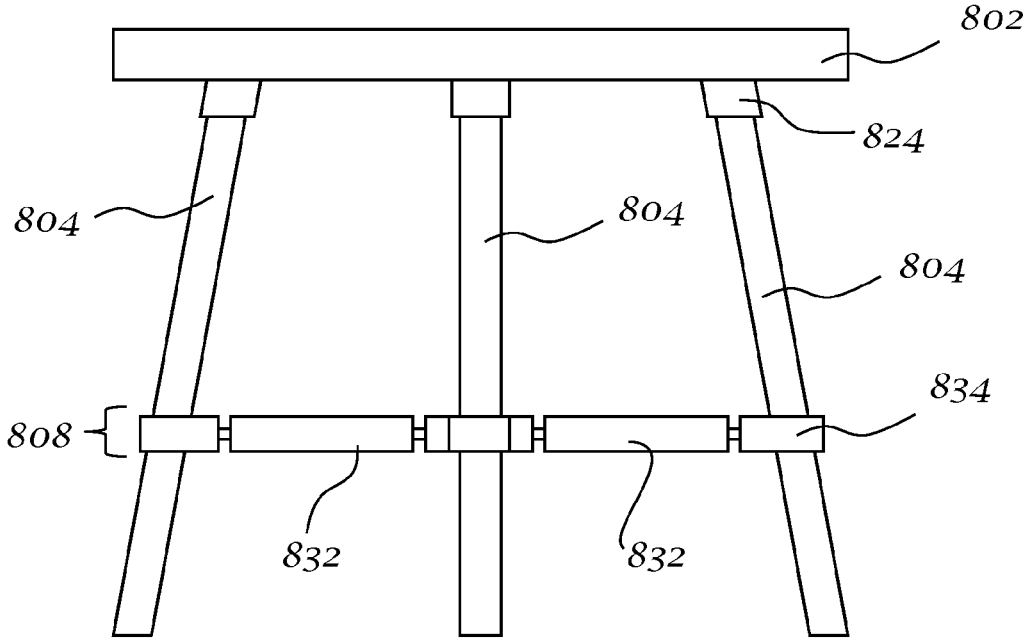
FIG. 8 shows an elevation view of an article of furniture.
Figure 9:
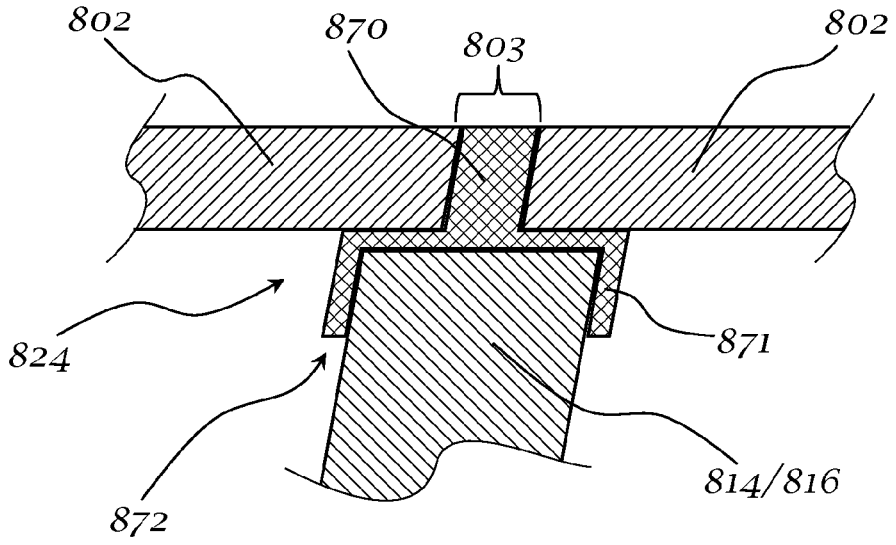
FIG. 9 shows a cross-sectional view of another support receptacle.
Figure 11:
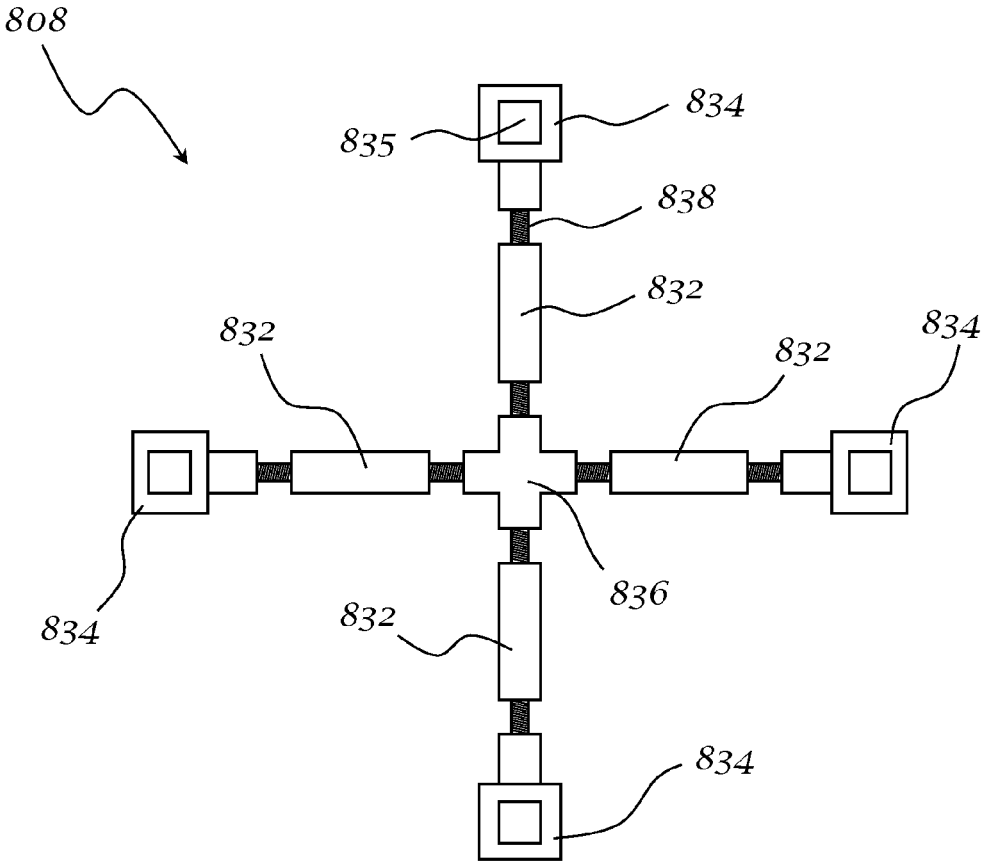
FIG. 11 shows a plan view of a stretcher.

As shown in FIG. 8, a stretcher 808 may be configured to engage and secure multiple supports 804. In an exemplary embodiment, stretcher 808 may be a quad stretcher and may be configured to engage and secure four supports 804. Stretcher 808 may operate substantially as described above. Stretcher 808 may include at least one tension adjuster 832. In an exemplary embodiment, stretcher 808 may have a tension adjuster 832 for each support 804 it engages. As shown in FIG. 11, this may be four. Stretcher ends 834 may be formed to engage a support 804 as described above, or may be formed to engage a support 804 by wrapping around the support 804. Stretcher ends formed in this manner may be used with all varieties of stretchers. In some embodiments, stretcher ends 834 may form a solid perimeter, surrounding a receiving cavity 835, requiring stretcher ends 834 to be slid over supports 804. Receiving cavity 835 may be formed to receive a support disposed at a desired angle.

Figure 10:
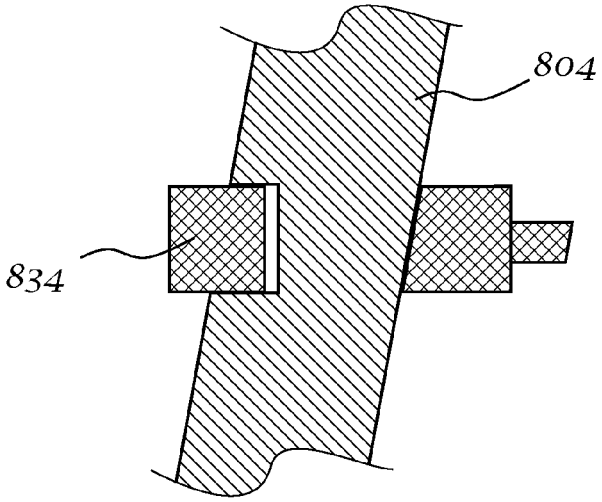
FIG. 10 shows a cross-sectional view of a stretcher end engaging a support.

In alternative embodiments, stretcher ends may separate or open to receive a support 804. As shown in FIG. 10, stretcher ends 834 may engage an engagement area of the support 804. This may allow the stretcher end 834 to more securely engage the support 804. As shown in exemplary FIG. 11, in a quad stretcher embodiment, opposite stretcher ends 834 there may be a central stretcher member 836. Tension adjusters 832 and connecting members 838 may function substantially as described above, allowing stretcher 808 to apply a force to each support 804. In at least one exemplary embodiment, connecting members 838 may be securely affixed to stretcher ends 834 and may adjustably engage tension adjuster 832. In some embodiments, tension adjuster 832 may engage central stretcher member 836, such that it can rotate freely.

Still further, countless variations on the above described exemplary embodiments may be utilized. The stretcher design and may be modified to accommodate a desired style, or a specific number of legs or supports. For example, a three-way stretch may be used for a three-legged piece of furniture. In some further embodiments, a quad stretcher may be configured substantially as a retractable rectangle, rather than a cross. In such an embodiment, the quad stretcher, which may be one multiple independent stretchers, may extend around the legs, connecting adjacent leg members. Other alternative embodiments may be envisioned, as would be understood by a person having ordinary skill in the art. In yet other exemplary embodiments, stretchers may be designed to engage supports in a vertical manner. For example, at least one stretcher could engage both supports 104,106 shown in FIG. 1 in a vertical manner. The vertical stretcher could resist a compression force between the supports, maintaining a desired orientation for the supports 104, 106, similar to the effect of the horizontal stretcher shown in FIG. 1.

The furniture may be constructed of any of a variety of materials, including wood, glass, plastic, metal, fiberglass, stone, rubber, concrete, ceramics, polymers, biomaterials, synthetic materials, recycled materials, composites or any other material that may be used in the construction of furniture, as would be understood by a person having ordinary skill in the art. Materials with a high strength, stiffness, or strength-to-weight ratio may be preferred. The furniture may also be constructed using a plurality of materials; for example, the furniture may have a wooden top or surface member and metal leg panel supports. Alternatively, it may have components constructed from a combination of materials; for example, the wooden surface member in the previous example may be fitted with a metal reinforcement. Materials that are not structurally functional may also be incorporated into the design; for example, the furniture may be covered with fabric, leather, or a similar material in order to give it a better appearance or to better accommodate users.

The foregoing description and accompanying drawings illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An article of furniture, comprising:

a surface member;

a plurality of supports for supporting the surface member, the plurality of supports having at least one engagement area, wherein at least two of the supports interlock at a pivot point;

one or more stretcher of adjustable length configured to removably engage at least two of the supports, wherein the one or more stretcher has at least two stretcher ends for engaging the at least one engagement area of the supports; and one or more tension adjusters that control the lengths of the one or more stretchers such that the one or more stretchers may apply or resist force on the at least two engaged supports.

2. The article of furniture of claim 1, wherein the surface member includes a plurality of substantially downward-facing slots sized to accommodate the plurality of supports.

3. The article of furniture of claim 2, further comprising a plurality of surface members, wherein the plurality of surface members have corresponding downward-facing slots configured to engage the plurality of supports, and wherein force applied by the supports on the plurality of surface members secures them in place.

4. The article of furniture of claim 2, wherein the plurality of downward-facing slots are disposed at an angle.

5. The article of furniture of claim 1, wherein the supports are legs.

6. The article of furniture of claim 5, wherein the at least one engagement area of the supports is a slot.

7. The article of furniture of claim 1, wherein the supports are panels.

8. The article of furniture of claim 1, wherein the article of furniture is constructed from at least one of wood, glass, plastic, metal, fiberglass, stone, rubber, concrete, ceramic, polymer, biomaterial, synthetic material, recycled material, or composite material.

9. An article of furniture, comprising:

a surface member;

a plurality of supports for supporting the surface member, the plurality of supports having at least one engagement area, wherein at least two of the supports interlock at a pivot point;

one or more support receptacle receiving cavity disposed in the surface member;

one or more support receptacle, the support receptacle having a substantially downward-facing slot that is sized to accommodate at least one of a plurality of supports and wherein the one or more support receptacle has a securing portion for engaging the one or more support receptacle receiving cavity;

one or more stretcher of adjustable length configured to removably engage at least two of the supports, wherein the one or more stretcher has at least two stretcher ends for engaging the at least one engagement area of the supports; and one or more tension adjuster that controls the lengths of the one or more stretcher such that the one or more stretcher may apply or resist force on the at least two engaged supports.

10. The article of furniture of claim 9, further comprising a plurality of surface members, wherein the one or more support receptacle may engage the one or more support receptacle receiving cavity of at least two surface members, removably securing the at least two surface members together.

11. The article of furniture of claim 10, further comprising a plurality of surface members, wherein the force applied on the support receptacles and surface members by supports engaged in the support receptacles further secures at least two surface members together.

12. The article of furniture of claim 9, wherein the supports are at least one of panels or legs.

13. The article of furniture of claim 9, wherein the article of furniture is constructed from at least one of wood, glass, plastic, metal, fiberglass, stone, rubber, concrete, ceramic, polymer, biomaterial, synthetic material, recycled material, or composite material.

14. The article of furniture of claim 9, wherein the securing portions of the one or more support receptacles are dovetailed.

15. The article of furniture of claim 9, wherein the one or more support receptacles are permanently affixed to the surface member.

16. The article of furniture of claim 9, wherein the one or more support receptacles are configured such that the substantially downward facing slots of the support receptacles are disposed at an angle.

17. The article of furniture of claim 9, wherein an end of support receptacle receiving cavity permits the securing portions of the one or more support receptacles to slide into or out of the support receptacle receiving cavity.

18. The article of furniture of claim 9, wherein the engagement sites are slots.

19. The article of furniture of claim 9, wherein the securing portions of the one or more support receptacle are substantially peglike.

20. The article of furniture of claim 9, wherein the substantially downward facing slot is configured to match the shape of the top edge of a support, such that the support receptacle may completely surround the top edge of the support.

* * * * *